US005273874A

United States Patent [19]

Kojima et al.

[11] Patent Number: 5,273,874

[45] **Date of Patent: * Dec. 28, 1993**

[54] SILVER HALIDE PHOTOGRAPHIC MATERIAL

[75] Inventors: Tetsuro Kojima; Hiroyuki Mifune, both of Kanagawa, Japan

[73] Assignee: Fuji Photo Film Co., Ltd., Kanagawa, Japan

[ * ] Notice: The portion of the term of this patent subsequent to Aug. 24, 2010 has been disclaimed.

[21] Appl. No.: 801,393

[22] Filed: Dec. 2, 1991

[30] Foreign Application Priority Data

Nov. 30, 1990 [JP] Japan ..... 2-333819

[51] Int. Cl.[5] ..... G03C 1/09

[52] U.S. Cl. ..... 430/600; 430/603; 430/604; 430/605

[58] Field of Search ..... 430/600, 603, 607, 569, 430/604, 605

[56] References Cited

U.S. PATENT DOCUMENTS

| | | | |
|---|---|---|---|
| 1,602,591 | 10/1926 | Sheppard | 430/603 |
| 4,810,626 | 3/1989 | Burgmaier et al. | 430/600 |
| 5,015,567 | 5/1991 | Suga et al. | 430/603 |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material comprises a silver halide emulsion layer provided on a support. In the photographic material of the present invention, the silver halide emulsion is sensitized with a new tellurium sensitizer. The tellurium sensitizer is represented by the formula (I) or (II):

(I)

(II)

in which each of $R^1$, $R^2$, $R^3$ and $R^4$ independently is an alkyl group, a cycloalkyl group, an alkenyl group, an alkynyl group, an aralkyl group, an aryl group, a heterocyclic group or an acyl group; at least two of $R^1$, $R^2$, $R^3$ and $R^4$ are combined with each other to form a heterocyclic ring; $R^5$ is an alkyl group, a cycloalkyl group, an alkenyl group, an alkynyl group, an aralkyl group, an aryl group or a heterocyclic group; $R^6$ is $—NR^7R^8$, $—NR^9—NR^{10}R^{11}$ or $—OR^{12}$; $R^5$ and $R^6$ may be combined with each other to form a heterocyclic ring; each of $R^7$, $R^8$, $R^9$, $R^{10}$, $R^{11}$ and $R^{12}$ independently is an alkyl group, a cycloalkyl group, an alkenyl group, an alkynyl group, an aralkyl group, an aryl group or a heterocyclic group; $R^7$ and $R^8$ may be combined with each other to form a heterocyclic ring; and $R^9$ and $R^{11}$ or $R^{10}$ and $R^{11}$ may be combined with each other to form a heterocyclic ring.

18 Claims, No Drawings

SILVER HALIDE PHOTOGRAPHIC MATERIAL

FIELD OF THE INVENTION

The present invention relates to a silver halide photographic material, and particularly relates to a silver halide photographic material improved in antifogging property, gradation, sensitivity and preservability.

BACKGROUND OF THE INVENTION

A silver halide photographic material comprises a silver halide emulsion layer provided on a support. The silver halide emulsion is usually chemically sensitized to obtain a desired sensitivity or gradation. Examples of the chemical sensitizer include a sulfur sensitizer, a selenium sensitizer, a tellurium sensitizer, a noble metal (such as gold) sensitizer, a reduction sensitizer and a combination thereof.

For several years there has been a growing demand for improvement of silver halide photography. The recent photographic material requires very high sensitivity. With respect to the obtained image, improvement of the graininess and the sharpness is required. A rapid image forming process such as a quick development process is also required. The sensitization and the sensitizer have been improved to meet these requirements.

The tellurium sensitization and the tellurium sensitizer are disclosed in U.S. Pat. Nos. 1,623,499, 3,320,069, 3,531,289, 3,655,394, 3,772,031 and 4,810,626, U.K. Patents No. 235,211, No. 1,121,496, No. 1,295,462 and No. 1,396,696, and Canadian Patent No. 800,958.

Canadian Patent No. 800,958 at page 2 discloses various tellurium sensitizers, which include colloidal tellurium metal; aliphatic isotellurocyantates; alkali metal, alkaline earth or ammonium salts; aliphatic telluroureas; and telluroketones. These tellurium sensitizers disclosed in Canadian Patent No. 800,958 are excellent in sensitivity, antifogging property and gradation. Canadian Patent No. 800,958 further describes that the sensitivity is greatly improved when the tellurium sensitizer is used in combination with a noble metal sensitizer.

SUMMARY OF THE INVENTION

The tellurium sensitizers disclosed in Canadian Patent No. 800,958 are excellent in various functions. According to study of the applicants, however, some problems are noted. When the tellurium sensitizer is used in a silver halide photographic material, the preservability of the photographic material is degraded. In more detail, the sensitivity of the photographic material containing the tellurium sensitizer tends to be degraded under severe conditions such as a high temperature and a high humidity. Further, the occurrence of fog is increased and $\gamma$ of the obtained image is decreased when the tellurium sensitizer is used in combination with a noble metal sensitizer. The term "$\gamma$" means the gradient ($\Delta D/\Delta \log H$) of the characteristic curve. The decrease of $\gamma$ indicates that the contrast of the image is reduced (a soft gradation).

An object of the present invention is to provide a silver halide photographic material improved in antifogging property, gradation and sensitivity.

Another object of the invention is to provide a photographic material showing a high sensitivity even if the material is preserved under severe conditions.

A further object of the invention is to provide a high sensitive photographic material which quickly forms a clear image.

There is provided by the present invention a silver halide photographic material which comprises a silver halide emulsion layer provided on a support, wherein the silver halide emulsion is sensitized with a tellurium sensitizer represented by the formula (I):

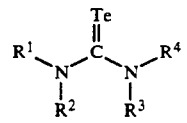

(I)

in which each of $R^1$, $R^2$, $R^3$ and $R^4$ independently is an alkyl group, a cycloalkyl group, an alkenyl group, an alkynyl group, an aralkyl group, an aryl group, a heterocyclic group or an acyl group, each of which may have a substituent group; at least two of $R^1$, $R^2$, $R^3$ and $R^4$ are combined with each other to form a heterocyclic ring.

There is also provided by the invention a silver halide photographic material which comprises a silver halide emulsion layer provided on a support, wherein the silver halide emulsion is sensitized with a tellurium sensitizer represented by the formula (II):

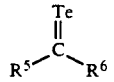

(II)

in which $R^5$ is an alkyl group, a cycloalkyl group, an alkenyl group, an alkynyl group, an aralkyl group, an aryl group or a heterocyclic group, each of which may have a substituent group; $R^6$ is $-NR^7R^8$, $-NR^9-NR^{10}R^{11}$ or $-OR^{12}$; $R^5$ and $R^6$ may be combined with each other to form a heterocyclic ring; each of $R^7$, $R^8$, $R^9$, $R^{10}$, $R^{11}$ and $R^{12}$ independently is an alkyl group, a cycloalkyl group, an alkenyl group, an alkynyl group, an aralkyl group, an aryl group or a heterocyclic group, each of which may have a substituent group; $R^7$ and $R^8$ may be combined with each other to form a heterocyclic ring; and $R^9$ and $R^{11}$ or $R^{10}$ and $R^{11}$ may be combined with each other to form a heterocyclic ring.

The present inventors found the new tellurium sensitizer represented by the formula (I) or (II). Using this tellurium sensitizer, the sensitivity, the antifogging property, the gradation and the preservability of the silver halide photographic material are greatly improved. The sensitivity of the photographic material of the present invention is as high as that of the material containing a conventional tellurium sensitizer. On the other hand, the occurrence of fog is reduced, compared with the material containing the conventional tellurium sensitizer. Further, the photographic material of the present invention has a hard gradation (high contrast). Furthermore, the sensitivity of the photographic material of the present invention is high even if the material is preserved under severe conditions.

DETAILED DESCRIPTION OF THE INVENTION

The silver halide photographic material of the present invention is characterized in that the silver halide emulsion is sensitized with the new tellurium sensitizer represented by the formula (I) or (II).

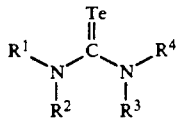

(I)

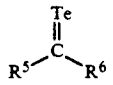

(II)

In the formula (I), each of $R^1$, $R^2$, $R^3$ and $R^4$ independently is an alkyl group, a cycloalkyl group, an alkenyl group, an alkynyl group, an aralkyl group, an aryl group, a heterocyclic group or an acyl group. An alkyl group, a cycloalkyl group, an alkenyl group, an aralkyl group, an aryl group and a heterocyclic group are preferred. An alkyl group and an aryl group are particularly preferred.

The alkyl group preferably has 1 to 40 carbon atoms, and more preferably has 1 to 20 carbon atoms. Examples of the alkyl group include methyl, ethyl, n-propyl, t-butyl, isopropyl and n-octyl.

The cycloalkyl group preferably has 3 to 40 carbon atoms. Examples of the cycloalkyl group include cyclopentyl, cyclohexyl, 2-methylcyclohexyl and adamantyl.

The alkenyl group preferably has 2 to 40 carbon atoms. Examples of the alkenyl group include allyl, 2-butenyl and 3-pentenyl.

The alkynyl group preferably has 2 to 40 carbon atoms. Examples of the alkynyl group include propargyl and 3-pentynyl.

The aralkyl group preferably has 7 to 40 carbon atoms. Examples of the aralkyl group include benzyl and phenethyl.

The aryl group preferably has 6 to 40 carbon atoms, and more preferably has 6 to 20 carbon atoms. Examples of the aryl group include phenyl, naphthyl and 4-methylphenyl.

The heterocyclic group preferably has 1 to 40 carbon atoms. Examples of the heterocyclic group include pyridyl, thienyl, furyl, imidazolyl, piperidyl and morpholinyl.

The acyl group preferably has 1 to 40 carbon atoms. Examples of the acyl group include acetyl, benzoyl, formyl and pivaloyl.

Each of $R^1$, $R^2$, $R^3$ and $R^4$ may have one or more substituent group. Examples of the substituent group include an alkyl group having 1 to 20 carbon atoms (e.g., methyl, ethyl, t-butyl), a cycloalkyl group having 3 to 20 carbon atoms (e.g., cyclopentyl, cyclohexyl, adamantyl), an alkenyl group having 2 to 20 carbon atoms (e.g., allyl, 3-pentenyl), an alkynyl group having 2 to 20 carbon atoms (e.g., e.g., propargyl, 3-pentynyl), an aralkyl group having 7 to 20 carbon atoms (e.g., benzyl, phenethyl), an aryl group having 6 to 20 carbon atoms (e.g., phenyl, naphthyl), a heterocyclic group having 1 to 20 carbon atoms (e.g., pyridyl, thienyl, furyl, imidazolyl, piperidyl, morpholinyl, benztriazolyl, benzoxazolyl, thiazolyl, tetrazolyl, tetrazaindenyl, indolyl), an acyl group having 1 to 20 carbon atoms (e.g., acetyl, benzoyl, formyl, pivaloyl), carboxyl, an alkoxycarbonyl group having 2 to 20 carbon atoms (e.g., methoxycarbonyl, ethoxycarbonyl), an aryloxycarbonyl group having 7 to 20 carbon atoms (e.g., phenoxycarbonyl), an acyloxy group having 1 to 20 carbon atoms (e.g., acetoxy, benzoyloxy), amino, a substituted amino group having 1 to 20 carbon atoms (e.g., dimethylamino, ethylamino), an ammonio group having 3 to 20 carbon atoms (e.g., trimethylammonio), an acylamino group having 1 to 20 carbon atoms (e.g., acetylamino, benzoylamino), carbamoyl, a substituted carbamoyl group having 2 to 20 carbon atoms (e.g., dimethylcarbamoyl, propylcarbamoyl), a sulfonylamino having 1 to 20 carbon atoms (e.g., benzensulfoamido), sulfamoyl, a substituted sulfamoyl group having 1 to 20 carbon atoms (e.g., N-methylsulfamoyl), an alkoxy group having 1 to 20 carbon atoms (e.g., methoxy, ethoxy, isopropoxy), an aryloxy group having 6 to 20 carbon atoms (e.g., phenoxy), an alkylthio group having 1 to 20 carbon atoms (e.g., methylthio, ethylthio), an arylthio group having 6 to 20 carbon atoms (e.g., phenylthio), a sulfonyl group having 1 to 20 carbon atoms (e.g., mesyl, benzenesulfonyl), a sulfinyl group having 1 to 20 carbon atoms (e.g., methanesulfinyl, ethanesulfinyl), sulfo, hydroxyl, a halogen atom (e.g., fluorine, chlorine, bromine), cyano, nitro, ureido, a substituted ureido group having 2 to 20 carbon atoms (e.g., N'-methylureido), phosphono and mercapto.

In the formula (I), at least two of $R^1$, $R^2$, $R^3$ and $R^4$ are combined with each other to form a heterocyclic ring. The heterocyclic ring preferably is a 5-membered or 6-membered ring. Examples of the linking group for the heterocyclic ring which is formed by two of $R^1$, $R^2$, $R^3$ and $R^4$ include an alkylene group having 1 to 40 carbon atoms (e.g., methylene, ethylene, propylene, butylene, hexylene, 1-methylethylene), an alkenylene group having 1 to 40 carbon atoms, an aralkylene group (e.g., benzylidene) having 7 to 40 carbon atoms, an arylene group having 6 to 40 carbon atoms (e.g., phenylene, naphthylene), an ether group, a thioether group, imino, a substituted imino group having 1 to 20 carbon atoms, carbonyl and a combination thereof (e.g., $-CO-CH=C(CH_3)-$, $-CO-CH_2-CO-$, $-CH_2CH_2OCH_2CH_2-$, $-CH_2CH_2NHCH_2CH_2-$). An alkylene group having 1 to 20 carbon atoms and an arylene group having 6 to 20 carbon atoms are particularly preferred. The linking group for the heterocyclic ring may have one or more substituent group. Examples of the substituent group are the same as those of the substituent group for $R^1$, $R^2$, $R^3$ and $R^4$.

In the formula (I), $R^2$ and $R^3$ are preferably combined with each other to form a heterocyclic ring. Namely, the tellurium sensitizer is preferably represented by the formula (Ia).

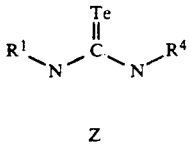

(Ia)

Z

In the formula (Ia), each of $R^1$ and $R^4$ independently is an alkyl group, a cycloalkyl group, an alkenyl group, an alkynyl group, an aralkyl group, an aryl group, a heterocyclic group or an acyl group. Examples of these groups are the same as those of $R^1$, $R^2$, $R^3$ and $R^4$ in the formula (I). Each of the groups may have a substituent group. Examples of the substituent group are the same as those of the substituent group for $R^1$, $R^2$, $R^3$ and $R^4$.

Z in the formula (Ia) is an atomic group which forms a heterocyclic ring. Z preferably is an alkylene group, an alkenylene group or an arylene group, each of which may have a substituent group. The heterocyclic ring formed by Z in the formula (Ia) preferably is a 5-membered or 6-membered ring. Examples of the heterocyclic ring formed by Z in the formula (Ia) include a tellurobarbituric acid ring and a tellurouracil ring.

In the formula (II), $R^6$ is $-NR^7R^8$, $-NR^9-NR^{10}R^{11}$ or $-OR^{12}$. Accordingly, the formula (II) can be divided into the following formulas (IIa), (IIb) and (IIc).

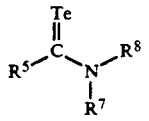
(IIa)

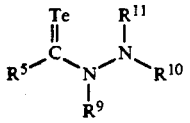
(IIb)

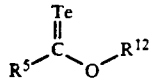
(IIc)

In the formulas (IIa), (IIb) and (IIc), each of $R^5$, $R^7$, $R^8$, $R^9$, $R^{10}$, $R^{11}$ and $R^{12}$ independently is an alkyl group, a cycloalkyl group, an alkenyl group, an alkynyl group, an aralkyl group, an aryl group or a heterocyclic group. An alkyl group, a cycloalkyl group, an aralkyl group, an aryl group and a heterocyclic group are preferred. An alkyl group and an aryl group are particularly preferred.

The alkyl group preferably has 1 to 40 carbon atoms, and more preferably has 1 to 20 carbon atoms. Examples of the alkyl group include methyl, ethyl, n-propyl, t-butyl, isopropyl and n-octyl.

The cycloalkyl group preferably has 3 to 40 carbon atoms. Examples of the cycloalkyl group include cyclopentyl, cyclohexyl, 2-methylcyclohexyl and adamantyl.

The alkenyl group preferably has 2 to 40 carbon atoms. Examples of the alkenyl group include allyl, 2-butenyl and 3-pentenyl.

The alkynyl group preferably has 2 to 40 carbon atoms. Examples of the alkynyl group include propargyl and 3-pentynyl.

The aralkyl group preferably has 7 to 40 carbon atoms. Examples of the aralkyl group include benzyl and phenethyl.

The aryl group preferably has 6 to 40 carbon atoms, and more preferably has 6 to 20 carbon atoms. Examples of the aryl group include phenyl, naphthyl and 4-methylphenyl.

The heterocyclic group preferably has 1 to 40 carbon atoms. Examples of the heterocyclic group include pyridyl, thienyl, furyl, imidazolyl, piperidyl and morpholinyl.

Each of $R^5$, $R^7$, $R^8$, $R^9$, $R^{10}$, $R^{11}$ and $R^{12}$ may have one or more substituent group. Examples of the substituent group are the same as those of the substituent group for $R^1$, $R^2$, $R^3$ and $R^4$ in the formula (I).

In the formula (IIa), two of $R^5$, $R^7$ and $R^8$ may be combined with each other to form a heterocyclic ring.

In the formula (IIb), two of $R^5$, $R^9$, $R^{10}$ and $R^{11}$ may be combined with each other to form a heterocyclic ring.

In the formula (IIc), $R^5$ and $R^{12}$ may be combined with each other to form a heterocyclic ring.

The details of the heterocyclic ring in the formulas (IIa), (IIb) and (IIc) are the same as those of the heterocyclic ring formed in the formula (I).

Examples of the tellurium sensitizer represented by the formula (I) or (II) are shown below.

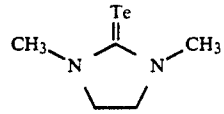
(I-1)

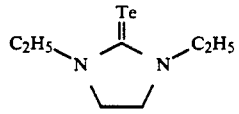
(I-2)

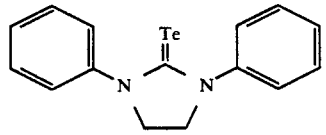
(I-3)

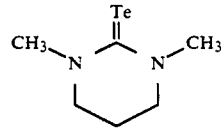
(I-4)

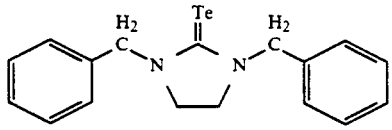
(I-5)

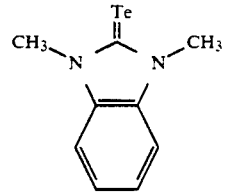
(I-6)

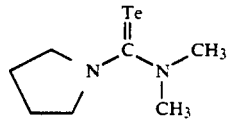
(I-7)

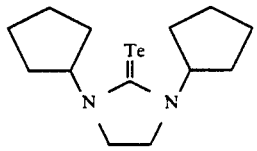
(I-8)

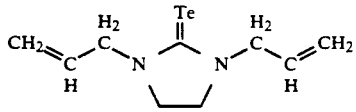
(I-9)

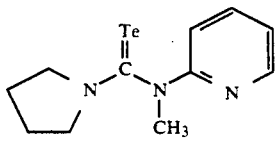
(I-10)

-continued
(I-11)
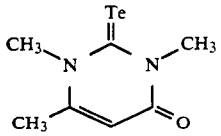
(I-12)
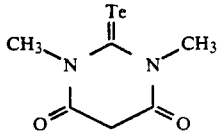
(I-13)
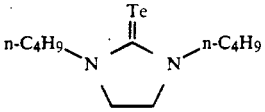
(I-14)
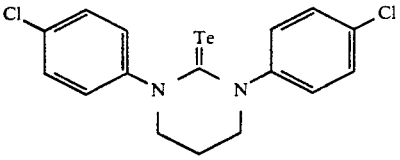
(II-1)
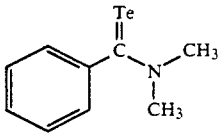
(II-2)
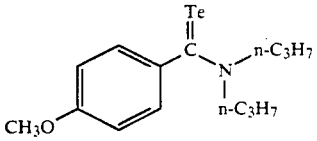
(II-3)
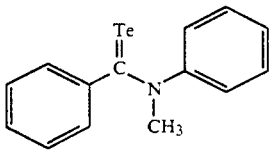
(II-4)
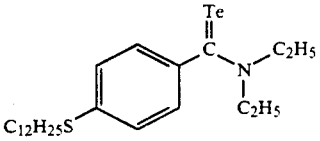
(II-5)
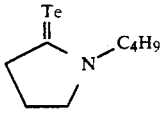
(II-6)
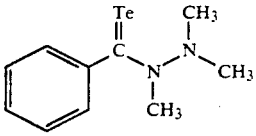
-continued
(II-7)
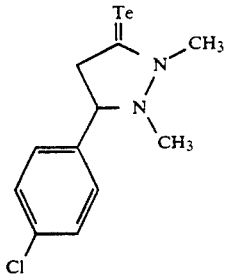
(II-8)
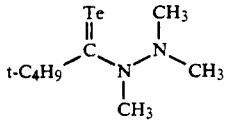
(II-9)
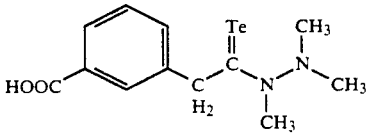
(II-10)
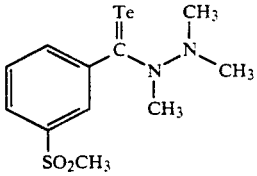
(II-11)
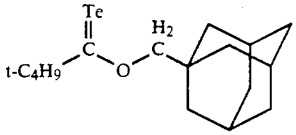
(II-12)
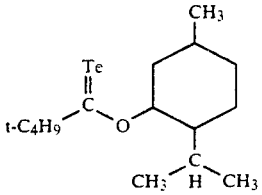
(II-13)
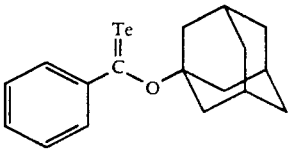
(II-14)
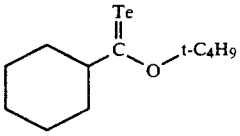
(II-15)
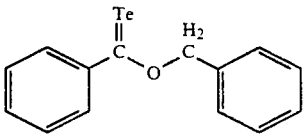

-continued

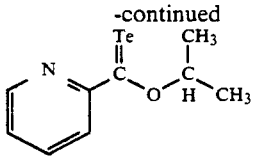

(II-16)

The compound represented by the formula (I) or (II) can be synthesized according to the known methods, which are described in J. Chem. Soc. Chem. Commun. 634 (1980), 1102 (1979), 645 (1979) and 820 (1987); J. Chem. Soc. Perkin Tras. 1, (1980); and The Chemistry of Organo Selenium and Tellurium Compounds, Vol. 2, 216-267 (1987).

The amount of the tellurium sensitizer contained in the photographic material depends on the nature of the tellurium sensitizer, the silver halide grains and the conditions of the chemical sensitization. The amount is preferably in the range of $10^{-8}$ to $10^{-4}$ mole based on 1 mole of the silver halide, and more preferably in the range of $10^{-7}$ to $10^{-5}$ mole.

The silver halide emulsion is sensitized with the tellurium sensitizer at a pAg preferably in the range of 6 to 11, more preferably in the range of 7 to 10, and most preferably in the range of 7 to 9.5. The silver halide emulsion is sensitized with the tellurium sensitizer at a temperature preferably in the range of 40° C. to 95° C., and more preferably in the range of 50° C. to 85° C.

In the photographic material of the invention, the silver halide emulsion is preferably sensitized with a noble metal (such as gold, platinum, palladium, iridium) sensitizer in addition to the tellurium sensitizer. A gold sensitizer is particularly preferred. Examples of the gold sensitizer include chloroauric acid, potassium chloroaurate, potassium aurithiocyanate, gold sulfide and gold selenide. The noble metal sensitizer is preferably used in an amount of $10^{-7}$ to $10^{-2}$ mole based on 1 mole of the silver halide.

In the photographic material of the invention, the silver halide emulsion can be sensitized with a sulfur sensitizer in addition to the tellurium sensitizer. The sulfur sensitizer is an unstable sulfur compound such as a thiosulfate (e.g., hypo), a thiourea (e.g., diphenylthiourea, triethylthiourea, allylthiourea) and rhodanine. The sulfur sensitizer is preferably used in an amount of $10^{-7}$ to $10^{-2}$ mole based on 1 mole of the silver halide.

In the photographic material, the silver halide emulsion can also be sensitized with a selenium sensitizer in addition to the tellurium sensitizer. Examples of the selenium sensitizer include colloidal selenium metal, a selenourea (e.g., N,N-dimethylselenourea, tetramethylselenourea, N-acetyl-N,N',N'-trimethylselenourea), a selenoketone and a selenoamide. The selenium sensitizer is preferably used in an amount of $10^{-8}$ to $10^{-3}$ mole based on 1 mole of the silver halide.

Further, the silver halide emulsion can also be sensitized with a reduction sensitizer in addition to the tellurium sensitizer. Examples of the reduction sensitizer include stannous chloride, aminoiminomethanesulfinic acid, a hydrazine derivative, borane, silane and a polyamine compound.

Two or more sensitization can be used in combination of the tellurium sensitization of the present invention. Examples of the combination include tellurium-gold-sulfur, tellurium-gold-selenium and tellurium-gold-sulfur-selenium.

The silver halide emulsion is sensitized with the tellurium sensitizer preferably in the presence of a silver halide solvent. Examples of the silver halide solvent include ammonia, a thiocyanate (e.g., potassium thiocyanate, ammonium thiocyanate), a thioether (e.g., 3,6-dithia-1,8-octanediol), a tetra-substituted thiourea compound (e.g., tetramethylthiourea), a thion compound, a mercapto compound, a mesoionic compound, a selenoether, a telluroether, a sulfite and an amine. A thiocyanate, a thioether, a tetra-substitued thiourea compound and a thion compound are preferred. The silver halide solvent is preferably used in an amount of $10^{-5}$ to $5\times10^{-5}$ mole based on 1 mole of the silver halide. The thioether is described in U.S. Pat. Nos. 3,021,215, 3,271,157, 3,574,628, 3,704,130, 4,276,374 and 4,297,439, Japanese Patent Publication No. 58(1983)-30571, and Japanese Patent Provisional Publication No. 60(1985)-136736. The tetra-substitued thiourea compound is described in U.S. Pat. No. 4,221,863 and Japanese Patent Publication No. 59(1984)-11892. The thion compound is described in Japanese Patent Publication No. 60(1985)-29727, and Japanese Patent Provisional Publications No. 53(1978)-144319, No. 53(1978)-82408 and No. 55(1980)-77737. The mercapto compound is described in Japanese Patent Publication No. 63(1988)-29727. The mesoionic compound is Japanese Patent Provisional Publication No. 60(1985)-163042. The selenoether is described in U.S. Pat. No. 4,782,013. The telluroether is described in Japanese Patent Provisional Publication No. 2(1990)-118566. The amine is described in Japanese Patent Provisional Publication No. 54(1979)-100717.

The silver halide emulsion used in the present invention preferably is a silver bromide, silver iodobromide, silver iodochlorobromide, silver chlorobromide or silver chloride emulsion.

The shape of the silver halide grain in the photographic emulsion may be either in the form of a regular crystal such as cube and octahedron or in the form of an irregular crystal such as globular shape and tabular shape. The shape of the grain may be complex of these crystals. A mixture of these crystals is also available. The regular crystal is particularly preferred.

The silver halide grain may have either a homogeneous structure or a heterogeneous structure in which halogens located at the inside and the outside are different from each other. The silver halide grain may have a layered structure in which iodide content in the inside layer and the outside layer are different from each other (particularly the iodide content in the inside layer is larger than in the outside layer). A latent image may be mainly formed either at the surface of the grain (a negative emulsion) or at the inside of the grain (an internal latent image emulsion or a direct reversal emulsion). A latent image is preferably formed at the surface of the grain.

The silver halide emulsion used in the invention preferably is a tubular grain emulsion in which tubular silver halide grains having a thickness of not more than 0.5 μm (preferably not more than 0.3 μm), a diameter of not more than 0.6 μm and a mean aspect ratio of not less than 5 are contained in an amount of 50% or more based on the total projected area of all the grains. Further, the silver halide emulsion used in the invention preferably is a monodispersed emulsion having such an almost uniform grain size distribution that a statistic coefficient of variation is not more than 20%. The coefficient of variation (S/d) is determined by dividing a standard deviation (S) by a diameter (d), which is determined by approximating the projected area of the grain to a circle. A mixture of the tubular grain emulsion and the monodispersed emulsion is also available.

The photographic emulsion used in the invention can be prepared by processes as described in P. Glafkides, "Chimie er Physique Photographeque" (published by Paul Monter Co., 1967), G. F. Duffin, "Photographic Emulsion Chemistry" (published by Focal Press, 1966), and V. L. Zelikman et al, "Making and Coating Photographic Emulsion" (published by Focal Press, 1964).

The above-mentioned silver halide solvent can be used to control the grain growth during formation of the silver halide grains.

At the stage for formation of the silver halide grains or physical ripening thereof, a cadmium salt, a zinc salt, a thallium salt, an iridium salt (or its complex salt), a rhodium salt (or its complex salt) or an iron salt (or its complex salt) can be added to the emulsion.

A hydrophilic colloid is used as a binder or a protective colloid for the emulsion layer or an intermediate layer of the photographic material of the invention. Gelatin is an advantageous hydrophilic colloid. The other protective colloids are also available. Examples of the other protective colloids include proteins such as a gelatin derivative, a graft polymer of gelatin and another polymer, albumin and casein; saccharide derivatives such as a cellulose derivative (e.g., hydroxyethyl cellulose, carboxymethyl cellulose and cellulose sulfate), sodium alginate and a starch derivative; and synthetic hydrophilic homopolymers or copolymers such as polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and oxygen-processed gelatin. The oxygen-processed gelatin is described in "Bull. Soc. Phot. Japan" No. 16, pp. 30 (1980). A hydrolysis product of gelatin is also available.

The hydrophilic colloidal layer of the photographic material can contain an inorganic or organic hardening agent. Examples of the hardening agent include a chromium salt, an aldehyde (e.g., formaldehyde, glyoxal and glutaraldehyde) and an N-methylol compound (e.g., dimethylol urea). An active halogen compound and an active vinyl compound are also available, and are preferably used because they give a stable photographic property to the photographic material. Examples of the active halogen compound include 2,4-dichloro-6-hydroxy-1,3,5-triazine and sodium salt thereof. Examples of the active vinyl compound include 1,3-bisvinylsulfonyl-2-propanol, 1,2-bis(vinylsulfonylacetamide)ethane, bis(vinylsulfonylmethyl)ether, and a vinyl polymer having vinylsulfonyl group on its side chain. Also preferred are an N.carbamoylpyrizinium salt (e.g., 1-morpholinocarbonyl-3-pyrizinio)methanesulfonate) and a haloamizinium salt (e.g., 1-(1-chloro-1-pyrizinomethylene)-pyrrolizinium 2-naphthalenesulfonate), which quickly harden the layers.

The silver halide photographic emulsion used in the invention can be spectrally sensitized by a sensitizing dye. Examples of the sensitizing dye include a methine dye, a cyanine dye, a merocyanine dye, a complex cyanine dye, a complex merocyanine dye, a holopolar cyanine dye, a hemicyanine dye, a styryl dye and a hemioxonol dye. A cyanine dye, a merocyanine dye and a complex merocyanine dye are particularly preferred. Those dyes have a basic heterocyclic ring, which is generally contained in the cyan dye. Examples of the ring include a pyrroline ring, an oxazoline ring, a thiazoline ring, a pyrrole ring, an oxazole ring, a thiazole ring, a serenazole ring, an imidazole ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthooxazole ring, a benzthiazole ring, a naphthothiazole ring, a benzserenazole ring, a benzimidazole ring and a quinoline ring. These rings may have a substituent group which is attached to the carbon atom of the rings.

The merocyanine dye or the complex merocyanine dye can contain a 5-membered or 6-membered heterocyclic ring having a ketomethylene structure such as a pyrazoline-5-one ring, thiohydantoin ring, a 2-thiooxazolidine-2,4-dione ring, a thizolidine-2,4-dione ring, a rhodanine ring and a thiobarbituric acid ring.

The sensitizing dyes can be used singly or in combination. A combination of the sensitizing dyes are often used for supersensitization. In addition to the sensitizing dyes, a supersensitizer can be contained in the photographic emulsion. The supersensitizer does not per se exhibit a spectral sensitization effect or does not substantially absorb visible light, but shows a supersensitizing activity. Examples of the supersensitizer include an aminostylbenzene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostylbenzene compound is described in U.S. Pat. Nos. 2,933,390 and 3,635,721. The condensate of an aromatic organic acid and formaldehyde is described in U.S. Pat. No. 3,743,510. The combination of the supersensitizers is described in U.S. Pat. Nos. 3,615,613, 3,615,641, 3,617,295 and 3,635,721.

The silver halide emulsion may contain an antifogging agent or a stabilizer. The antifogging agent prevents occurrence of a fog. The stabilizer has a function of stabilizing the photographic property. The antifogging agent and the stabilizer function in preparation, storage or processing stage of the photographic material. Examples of the antifogging agent and stabilizer include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5- mercaptotetrazole); mercaptopyrimidines; mercaptotriazines; thioketone compounds such as oxazolinethione; azaindenes such as triazaindenes, tetraazaindenes (e.g., 4-hydroxy-substituted (1,3,3a,7)tetraazaindenes) and pentaazaindenes; and amides such as benzenethiosulfonic amide, benzenesulfinic amide and benzenesulfonic amide.

The photographic material of the present invention may contain a surface active agent to improve various properties such as a coating property, an antistatic property, a slip properties, a emulsifying or dispersing property, an antitacking property and photographic properties (e.g., development acceleration, high contrast and sensitization).

The hydrophilic colloidal layer of the photographic material may contain a water-soluble dye. The water-soluble dye has various functions such as a function of antiirradiation or a function of antihalation as well as a function as a filter dye. Examples of the dye include an oxonol dye, a hemioxonol dye, a styryl dye, a merocyanine dye, an anthraquinone dye, an azo dye, a cyanine dye, an azomethine dye, a triallymethane dye and a phthalocyanine dye. Further, an oil-soluble dye can be also added to the hydrophilic colloidal layer by emulsifying the dye in water by a known oil droplet dispersing method.

The photographic material of the invention can be used as a multi-layered multicolor photographic material provided with two or more light-sensitive layers which have different spectral sensitivities on a support. The multi-layered color photographic material generally has at least one red-sensitive emulsion layer, at least one green-sensitive emulsion layer and at least one blue-sensitive emulsion layer on the support. The arrangement of those layers can be optionally determined. Preferably, the red-sensitive layer, the green sensitive layer and the blue sensitive layer are arranged from the support side in this order. The blue-sensitive layer, the green-sensitive layer and the red-sensitive layer may be arranged in this order from the support side. Further, the blue-sensitive layer, the red-sensitive layer and the green-sensitive layer may be arranged in this order from the support side. Further, two or more emulsion layers which are sensitive to the same color but show different sensitivities can be provided to enhance the sensitivity. Three emulsion layers can be provided to improve the graininess of the image. A non-light sensitive layer may be interposed between two or more emulsion layers having the same color sensitivity. Otherwise, between two or more emulsion layers having the same color sensitivity may be interposed another emulsion layer having a different color sensitivity. A light-reflecting layer such as a layer of silver halide grains can be provided under a high sensitive layer, particularly a high blue sensitive layer, to enhance the sensitivity.

In general, the red sensitive emulsion layer contains a cyan coupler, the green sensitive emulsion layer contains magenta coupler, and the red sensitive emulsion layer contains a yellow color-forming coupler. However, other combinations are also available. For example, an infrared sensitive layer can be used to prepare a false color film or a film for exposure to a semiconductor laser beam.

Various color couplers can be used for the invention. Concrete examples of the couplers are described in the patents cited in *Research Disclosure* No. 17643, VII C-G.

As a yellow coupler, preferred are those described in, for example, U.S. Pat. Nos. 3,933,501, 4,022,620, 4,326,024, 4,401,752 and 4,248,961, Japanese Patent Publication No. 58(1983)-10739, and U.K. Patents No. 1,425,020 and No. 1,476,760.

As a magenta coupler, 5-pyrazolone type and pyrazoloazole type compounds are preferred, and particularly preferred are those described in U.S. Pat. Nos. 4,310, 619 and 4,351,897, European Patent No. 73,636, U.S. Pat. Nos. 3,061,432 and 3,725,067, *Research Disclosure* No. 24220 (June, 1984), Japanese Patent Provisional Publication No. 60(1985)-33552, *Research Disclosure* No. 24230 (June, 1984), Japanese Patent Provisional Publications No. 60(1985)-43659, U.S. Pat. Nos. 4,500,630 and 4,540,654.

As a cyan coupler, there can be mentioned phenol type and naphthol type couplers, and preferred examples are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Publication No. 3,329,729, European Patents No. 121,365A and No. 161,626A, and U.S. Pat. Nos. 3,446,622, 4,333,999, 4,775,616, 4,451,559, 4,427,767, 4,690,889, 4,254,212 and 4,296,199.

A colored coupler may be used to compensate incidental absorption of a formed dye. The colored coupler is described in *Research Disclosure* No. 17643, VII-G, U.S. Pat. No. 4,163,670, Japanese Patent Publication No. 57(1982)-39413, U.S. Pat. Nos. 4,004,929 and 4,138,258, and U.K. Patent No. 1,146,368.

As a coupler which gives a color developing dye exhibiting a proper diffusion, preferred are those described in U.S. Pat. No. 4,366,237. U.K. Patent No. 2,125,570, European Patent No. 96,570, and West German Patent Publication No. 3,234,533.

Typical examples of polymerized dye-forming couplers are described in U.S. Pat. Nos. 3,451,820, 4,080,211, 4,367,282, 4,409,320 and 4,576,910, and U.K. Patent No. 2,102,173.

A coupler which releases a photographically useful, residue in accordance with a coupling reaction can be also used in the invention. A DIR coupler which releases a development inhibitor is available. The DIR coupler is described in *Research Disclosure* No. 17643, VII-F, Japanese Patent Provisional Publications No. 57(1982)-151944, No. 57(1982)-154234, No. 60(1985)-184248 and No. 63(1988)-37346, and U.S. Pat. No. 4,248,962.

A coupler which imagewise releases a nucleating agent or a development accelerator in a development process is also available. This coupler is described in U.K. Patents No. 2,097,140 and No. 2,131,188, and Japanese Patent Provisional Publications No. 59(1984)-157638 and No. 59(1984)-170840.

Examples of other couplers available for the photographic material of the invention include a competing coupler, a polyvalent coupler, a DIR redox compound-releasing coupler, a DIR coupler-releasing coupler, a DIR coupler-releasing redox compound, a DIR redox-releasing redox compound, a coupler which releases a dye having restoration to original color after an elimination reaction, a bleach accelerator-releasing coupler and a coupler which releases ligand. The competing coupler is described in U.S. Pat. No. 4,130,427. The polyvalent coupler is described in U.S. Pat. Nos. 4,283,472, 4,338,393 and 4,310,618. The DIR redox compound-releasing coupler, the DIR coupler-releasing coupler, the DIR coupler-releasing redox compound and the DIR redox-releasing redox compound are described in Japanese Patent Provisional Publications No. 60(1985)-185950 and No. 62(1987)-24252. The coupler which releases a dye having restoration to original color after elimination is described in European Patent No. 173,302A. The bleach accelerator-releasing coupler is described in *Research Disclosure* No. 11449, ibid. No. 24241, and Japanese Patent Provisional Publication No. 61(1986)-201247. The coupler which releases ligand is described in U.S. Pat. No. 4,553,477.

The couplers used in the invention can be introduced into the photographic material by various known dispersing methods.

Examples of a high-boiling solvent used in an O/W dispersing method are described in U.S. Pat. No. 2,322,027.

Examples of the high-boiling organic solvent having a boiling point of not lower than 175° C. under a normal pressure used in the O/W dispersing method include phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate, bis(1,1-diethylpropyl)phthalate); esters of phosphoric acid or phosphonic acid (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoates (e.g., 2-ethylhexyl benzoate, dodecyl benzoate, 2-ethylehecyl-p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributylate, isostearyl lactate, trioctyl citrate); aniline derivatives (e.g., N,N-dibutyl-2-butoxyl-5-tert-octylaniline); and hydrocarbons (e.g., paraffin, dodecyl benzene, diisopropyl naphthalene). An organic solvent having a boiling point of not lower than about 30° C. preferably in the range of 50° C. to about 160° C. can be used as an auxiliary solvent. Examples of the auxiliary solvent include ethyl acetate, butyl acetate, ethyl propionate, methyl ethyl ketone, cyclohexanone, 2-ethoxyethyl acetate and dimethylformamide.

A process of a latex dispersing method, effects thereof and concrete examples of latex for impregnation are described in U.S. Pat. No. 4,199,363, West German Patent Applications (OLS) No. 2,541,274 and No. 2,541,230.

There is no specific limitation on the support on which the above-mentioned silver halide emulsion layer is provided. As the support materials, there can be employed flexible materials which are generally used for known photographic materials, such as plastic films, papers and cloths; and rigid materials such as glass, ceramics and metals. Preferred examples of the flexible support materials include semi-synthetic or synthetic polymers such as cellulose nitrate, cellulose acetate, cellulose butyl acetate, polystyrene, polyvinyl chloride, polyethylene terephthalate and polycarbonate; baryta papers; and other papers coated or laminated with α-olefin polymers (e.g., polyethylene, polypropylene or ethylene-butene copolymer). The support may be colored with dyes or pigments. Further, the support may be made black for the purpose of light-blocking. The surface of the support is generally subjected to undercoating treatment for enhancing the adhesion with the photographic emulsion layer. The surface of the support may be further subjected to other various treatments such as glow discharge, corona discharge, irradiation with ultraviolet rays and flame treatment before or after the undercoating treatment.

The photographic emulsion layer and the hydrophilic colloidal layer can be coated on the support by a known coating method such as dip coating, roller coating, flood coating and extrusion coating. If desired, two or more layers can be simultaneously coated by the coating methods as described in U.S. Pat. Nos. 2,681,294, 2,761,791, 3,526,528 and 3,508,947.

The photographic material of the invention can be used as a monochromatic or color photographic material. Concretely, it can be used as color negative films for domestic use or cinematographic use; and other films or papers for slide projection use or television use, such as color reversal films, color papers, color positive films and color reversal papers. Further, the photographic material of the invention can be also used as monochromatic light-sensitive materials for X-rays by utilizing a mixture of three-color couplers described in "Research Disclosure" No. 17,123, (July, 1978), or utilizing black color-forming coupler described in U.S. Pat. No. 4,126,461 and U.K. Patent No. 2,102,136. Moreover, the photographic material of the invention can be also used as films for plate making (e.g., lithographic films and scanner films), X-ray films for medical use or industrial use, monochromatic negative films for picture-taking, monochromatic photographic papers, microfilms for COM use or domestic use, and other light-sensitive printing materials.

The photographic material of the present invention can be used in a color diffusion transfer process. The color diffusion transfer process can be classified into a peel apart type, an integrated type and a film unit type which does not require peeling. The integrated type is described Japanese Patent Publications No. 46(1971)-16356 and No. 48(1973)-33697, Japanese Patent Provisional Publication No. 50(1975)-13040, and U.K. Patent No. 1,330,524. The film unit type is described in Japanese Patent Provisional Publication No. 57(1982)-19345.

An acidic polymer layer protected with a neutralization timing layer can be provided in the color diffusion transfer photographic material. These layers have a function of allowing a broad latitude of the processing temperature.

The photographic light-sensitive material of the invention is used by an exposure process, a development process and a fixing process. Use of the photographic light-sensitive material of the present invention is described below.

Various exposure means can be employed in the exposure process. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, flash light sources (e.g., electric flash and metal-burning flashbulb). Light sources which emit light in the ultraviolet to infrared region can be also used as the recording light sources. For example, there can be mentioned gasses, dye solutions, semiconductor lasers, light emission diode, and plasma light source. Also employable are fluorescent surface given by the stimulated phosphor with electron rays (e.g., CRT) and an exposure means in which a microshutter array using liquid crystal (LCD) or lanthanum-doped lead zirconate titanate (PLZT) is combined with a linear or plane-like light source. If necessary, spectral distribution used in the exposure process can be appropriately adjusted by color filters.

A color developing solution used in the development process of the photographic material according to the invention preferably is an alkaline aqueous solution mainly containing an aromatic primary amine-color developing agent. As the color developing agents, aminophenol compounds and p-phenylenediamine compounds are preferably employed. Concrete examples of the p-phenylenediamine compounds include 3-methyl-4-amino-N,N-diethylaniline, 3-methyl-4-amino-N-ethyl-N-β-hydroxyethylaniline, 3-methyl-4-amino-N-ethyl- N-β-methanesulfonamidethylaniline, 3-methyl-4-amino-N-ethyl-N-β-methoxyethylaniline; and sulfates, chlorides and p-toluenesulfonates of those compounds. Generally, salts of diamines are more preferably employed than free diamines, because they show higher stability than free diamines.

The color developing solution generally contains pH buffering agents (e.g., carbonates of alkali metals, borates thereof and phosphates thereof), development inhibitors (e.g., bromides, iodides, benzimidazoles, benzothiazoles and mercapto compounds) or anti-fogging agents. If necessary, the color developing solution may further contain other additives such as preservatives (e.g., hydroxylamine and sulfite), organic solvents (e.g., triethanol amine and diethylene glycol), development accelerators (e.g., benzyl alcohol, polyethylene glycol, quarternary ammonium salts and amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid and phosphonocarboxylic acid), and antioxidants described in West German Patent Application (OLS) No. 2,622,950.

In the development process of color reversal photographic materials, color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). Those monochromatic developing agents can be employed singly or in combination.

The photographic emulsion layer is generally subjected to bleaching process after the color development process. The bleaching process may be done simultaneously with a fixing process or separately from the fixing process. For the rapid processing, a bleach-fix process can be made after the bleaching process. As the bleaching agents, there can be used polyvalent metal compounds such as iron (III), cobalt (III), chromium (IV) and copper (II), peracids, quinones, and nitroso compounds. Representative examples of the bleaching agents include ferricyanides; dichromates; organic complex salts of iron (III) or cobalt (III) such as complex salts of aminopolycarboxylic acids (e.g., ethylenediaminetetraacetic acid, diethylenetriaminepentaacetic acid, nitrilotriacetic acid and 1,3-diamino-2-propanol-tetraacetic acid) and complex salts of citric acid, tartaric acid and malic acid; persulfates; manganates; and nitrosophenol. Among them, ethylenediaminetetraacetic acid iron (III) salt, diethylenetriaminepentaacetic acid iron (III) salt and persulfate are preferred from the viewpoints of rapid processing and prevention of environmental pollution. Also preferred is ethylenediaminetetraacetic acid iron (III) complex salt in each of an individual bleaching solution (bleaching bath) and in a bleach-fix bath.

A bleaching accelerator can be optionally used in the bleaching bath, the bleach-fix bath or the prior bath to those baths. Examples of the effective bleaching accelerators include compounds having mercapto group or disulfide group as described in U.S. Pat. No. 3,893,858, West German Patents No. 1,290,812 and No. 2,059,988, Japanese Patent Provisional Publications No. 53(1978)-32736, No. 53(1978)-57831, No. 53(1978)-37418, No. 53(1978)-65732, No. 53(1978)-72623, No. 53(1978)-95630, No. 53(1978)-95631, No. 53(1978)-104232, No. 53(1978)-124424, No. 53(1978)-141623 and No. 53(1978)-28426, and "Research Disclosure", No. 17129 (July, 1978); thiazolidine derivatives as described in Japanese Patent Provisional Publication No. 50(1975)-140129; thiourea derivatives as described in Japanese Patent Publication No. 45(1970)-8506, Japanese Patent Provisional Publications No. 52(1977)-20832 and No. 53(1978)-32735, and U.S. Pat. No. 3,706,561; iodides as described in West German Patent No. 1,127,715 and Japanese Patent Provisional Publication No. 58(1983)-16235; polyethylene oxides as described in West German Patents No. 966,410 and No. 2,748,430; polyamine compounds as described in Japanese Patent Publication No. 45(1970)-8836; and compounds as described in Japanese patent Provisional Publications No. 49(1974)-42434, No. 49(1974)-59644, No. 53(1978)-94927, No. 54(1979)35727, No. 55(1980)-26506 and No. 58(1983)-163940. In addition to the above-mentioned compounds, iodine ion and bromine ion can be also employed as the bleaching accelerator. As the bleaching accelerator, preferred are compounds having mercapto group or disulfide group because these compounds show high acceleration effects, and particularly preferred are compounds described in U.S. Pat. No. 3,893,858, West German Patent No. 1,290,812 and Japanese Patent Provisional Publication No. 53(1978)-95630. Also preferred are compounds described in U.S. Pat. No. 4,552,834. The above-mentioned bleaching accelerators may be contained in the photographic material. Employment of the bleaching accelerators is particularly effective in the bleach-fix process of color photographic materials for picture-taking.

Examples of fixing agents include thiosulfates, thiocyanates, thioether compound, thioureas, and iodides. Of these, thiosulfates are generally used. As the bleach-fix bath or the preservative, sulfites, bisulfites and carbonylbisulfurous acid addition products are preferably employed.

After the bleach-fix process or the fixing process, the photographic light-sensitive material is generally subjected to washing with water and stabilization. In the washing stage or the stabilization stage, a variety of known compounds can be used for the purpose of preventing precipitation and saving water. For example, there can be used hard water-softening agents for preventing the precipitation, such as inorganic phosphoric acids, aminopolycarboxylic acids, organic aminopolyphosphoric acids and organic phosphoric acids; germicides, mildewcides and metal salts (e.g., magnesium salts, aluminium salts and bismuth salts) for preventing various bacteria, alga and mildew; surface active agents for preventing drying strain or drying mark; and various hardeners for film-hardening. Otherwise, compounds described in L. E. West, "Photographic Science And Engineering", vol. 6, pp 344–359, (1955) can be also employed. Particularly preferred are chelating agents and mildewcides.

In the washing process, countercurrent washing using two or more baths is generally employed to save water. Instead of the washing process, multi-stage countercurrent stabilizing process can be used, and in this case, 2–9 countercurrent baths are required. To the stabilizing baths are added various compounds to stabilize resulting images in addition to the above-mentioned additives. Examples of the compounds include various buffering agents for adjusting pH value of the resulting films (for example, adjusting to pH of 3–9), and aldehydes (e.g., formalin). Examples of the buffering agents include borates, methaborates, sodium tetraborate decahydrates, phosphates, carbonates, potassium hydroxide, sodium hydroxide, ammonia water, monocarboxylic acids, dicarboxylic acids and polycarboxylic acids, in appropriate combination. Further, if desired, other additives such as chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, irithiazorone, 4-thiazolinebenzimidazole, halogenated phenol, sulfanylamide and benzotriazole), surface active agents, brightening agents and hardeners can be also employed. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weight.

The time required for the washing and stabilizing process depends on the kind of the photographic material or the treating conditions, but generally is in the range of 20 seconds to 10 minutes, preferably in the range of 20 seconds to 5 minutes.

The silver halide color photographic material can contain a color developing agent for the purpose of simple processing and rapid processing. For incorporation of the color developing agent, various precursors releasing the color developing agents can be preferably employed. Examples of the precursors employable for the purpose include indolenine compounds as described in U.S. Pat. No. 3,342,597; Shchiff's base type compounds as described in U.S. Pat. No. 3.342.599 and "Research Disclosure", Nos. 14,850 and 15159; aldol compounds as described in "Research Disclosure", No. 13,924; metal complex salts as described in U.S. Pat. No. 3,719,492; urethane compounds as described in Japanese Patent Provisional Publication No. 53(1978)-135628; and other salt type precursors as described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

Into the silver halide color photographic material may be incorporated 1-phenyl-3-pyrazolidones to accelerate color development. Typical compounds used for the purpose are described for example in Japanese Patent Provisional Publications No. 56(1981)-64339, No. 57(1982)-144547, No. 57(1982)-211147, No. 58(1983)-50532, No. 58(1983)-50533, No. 58(1983)-50534, No. 58(1983)-50535, No. 58(1983)-50536 and No. 58(1083)-115438.

The various baths (solutions) used in the above-mentioned processes generally can have a temperature ranging from 10° to 50° C. The temperature thereof generally is in the range of 33° to 38° C., but it can be made higher to accelerate the processing so as to shorten the processing time. Otherwise, it can be made lower to improve qualities of the resulting images or to enhance the stability of the baths. Further, cobalt intensification described in West German Patent No. 2,226,770 or hydrogen peroxide intensification described in U.S. Pat. No. 3,674,499 can be made to save the silver of the photographic material.

The above-mentioned various baths may be equipped with a heater, a temperature sensor, a liquid level sensor, a circulating pump, a filter, a floating lid or a squeegee, if desired.

In the continuous processing, a replenisher for each bath can be used to prevent the bath composition from varying, whereby a uniform finish can be obtained. The replenisher can be used in an amount of half of the standard amount or smaller amount than half of the standard amount to reduce the cost.

When the photographic material of the invention is used as a color paper, the above-mentioned bleach-fix process is generally made, and when the photographic material of the invention is used as a color photographic material for picture-taking, the same process is made according to the necessity.

The present invention is further described by the following examples.

EXAMPLE 1

To 1.2 l of 3.0 weight % aqueous gelatin solution containing 0.06 mole of potassium bromide while stirring was added 30 ml of 25 weight % aqueous solution of ammonia. The resulting mixture contained in a reaction vessel was kept at 65° C. To the mixture were added 50 ml of 0.3 mole silver nitrate solution and 50 ml of aqueous silver salt solution containing 0.063 mole of potassium iodide and 0.19 mole of potassium bromide over a period of 3 minutes according to a double jet method. Thus, silver iodobromide grains were formed as the core. The grains had the mean grain size of 0.15 μm as the diameter of the circle corresponding to the projected area. The silver iodide content was 25 mole %.

To the emulsion was further added the aqueous solution of ammonia at 65° C. in the same manner as is mentioned above. To the mixture were added 800 ml of 1.5 mole silver nitrate solution and 800 ml of aqueous silver salt solution containing 0.375 mole of potassium iodide and 1.13 mole of potassium bromide over a period of 80 minutes according to a double jet method to form the first coated layer of the silver halide grains. The obtained octahedral grains had the mean grain size of 0.71 μm as the diameter of the circle corresponding to the projected area. The silver iodide content was 25 mole %.

The emulsion was neutralized by acetic acid. To the emulsion contained in a mixing vessel were added 1.5 mole silver nitrate solution and 1.5 mole potassium bromide solution to form the second coated layer (silver bromide shell) of the silver halide grains. Thus, a monodispersed (coefficient of variation: about 18%) octahedral core/shell emulsion was prepared. The grains had the mean grain size of 0.89 μm as the diameter of the circle corresponding to the projected area. The ratio of the first coated layer to the second coated layer was 1:1.

The emulsion was then cooled to 35° C., desalted according to a conventional flocculation method, and washed with water. To the emulsion were further added gelatin and water. The emulsion was adjusted to pH 6.4 and pAg 8.6 at 40° C.

The obtained emulsion was divided into 10 parts. To each of the parts was added the compound set forth in Table 1 at 60° C. To the emulsion was further added chloroauric acid ($1.8\times10^{-5}$ mole/1 mole of silver halide) and potassium thiocyanate ($8\times10-4$ mole/1 mole of silver halide), and the emulsion was chemically sensitized under the optimum conditions. To the emulsion were added the following compounds to prepare a coating solution.

Sensitizing dye: Sodium salt of anhydro-5-chloro-5'-phenyl-9-ethyl-3,3'-di(3-sulfopropyl)oxacarbocyaninehydroxyde Magenta coupler: 3-{3-[2-(2,4-Di-tert-amylphenoxy) butylylamino]benzoylamino}-1-(2,4,6-trichlorophenyl) pyrazoline-5-on Oil: Tricresylphosphate Stabilizer: 4-Hydroxy-6-methyl-1,3,3a,7-tetrazaindene Antifogging agent: Monosodium salt of 1-(m-sulfophenyl)-5-mercaptotetrazole Coating aid: Sodium dodecylbenzenesulfonate Hardening agent: Sodium salt of 2,4-dichloro-6-hydroxy-S-triazine Antiseptic: Phenoxyethanol On a triacetyl cellulose film was provided an undercoating layer to prepare a support. On the support were coated the above-prepared coating solution for the emulsion layer and a coating solution for a gelatin protective layer simultaneously according to a pressing out method.

Each of the prepared samples No. 1 to No. 10 was exposed to light through an optical wedge for 1/250 second, and subjected to the following process at 38° C.

| | |
|---|---|
| 1. Color development | 2 minutes and 45 seconds |
| 2. Bleaching | 6 minutes and 30 seconds |
| 3. Washing | 3 minutes and 15 seconds |
| 4. Fixing | 6 minutes and 30 seconds |
| 5. Washing | 3 minutes and 15 seconds |
| 6. Stabilizing | 3 minutes and 15 seconds |

The compositions of the processing solution are set forth below.

| | |
|---|---|
| Color developing solution | |
| Sodium nitrilotriacetate | 1.0 g |
| Sodium sulfite | 4.0 g |
| Sodium carbonate | 40.0 g |
| Potassium bromide | 1.4 g |
| Sulfate salt of hydroxylamine | 2.4 g |
| Sulfate salt of 4-(N-ethyl-N-β-hydroxyethylamino)-2-methyl-aniline | 5.0 g |
| Water | to make up to 1 l |
| Bleaching solution | |
| Ammonium bromide | 160.0 g |
| Ammonia water (28%) | 25.0 ml |
| Sodium Fe(II) ethylenediaminetetraacetate | 130 g |
| Glacial acetic acid | 14 ml |
| Water | to make up to 1 l |
| Fixing solution | |
| Sodium tetrapolyphosphate | 2.0 g |
| Sodium sulfite | 4.0 g |
| Ammonium thiosulfate solution (70%) | 175.0 ml |

-continued

| | |
|---|---|
| Sodium bisulfite | 4.6 g |
| Water | to make up to 1 l |
| Stabilizing solution | |
| Formalin | 8.0 ml |
| Water | to make up to 1 l |

The sensitivity, the value of "γ" and the fog of the obtained image were evaluated. The results are set forth in Table 1. The sensitivity was measured as the reciprocal of the exposure required for the increase of the optical density to the fogging value+0.5. The sensitivity set forth in Table 1 is the relative value where the value of the sample No. 1 is 100.

TABLE 1

| Sample No. | Sensitizer Kind | Amount $10^{-5}$ mole | Sensitivity | "γ" | Fog |
|---|---|---|---|---|---|
| 1 | Sodium thiosulfate | 1.6 | 100 | 0.90 | 0.19 |
| 2 | Colloidal tellurium metal | 5.6 | 136 | 0.75 | 0.33 |
| 3 | Tetramethyltellurourea | 1.2 | 142 | 0.82 | 0.38 |
| 4 | (I-1) | 1.2 | 144 | 1.00 | 0.26 |
| 5 | (I-2) | 1.2 | 140 | 0.98 | 0.30 |
| 6 | (I-4) | 1.2 | 138 | 0.90 | 0.28 |
| 7 | (II-1) | 1.2 | 142 | 0.93 | 0.29 |
| 8 | (II-7) | 1.2 | 136 | 0.90 | 0.30 |
| 9 | (I-1) + | 0.8 | 132 | 0.95 | 0.21 |
| | Sodium thiosulfate | 1.2 | | | |
| 10 | (I-1) + | 0.8 | 148 | 0.90 | 0.24 |
| | Sodium thiosulfate + | 1.0 | | | |
| | N,N-dimethylselenourea | 0.2 | | | |

Remark: Colloidal tellurium metal (Sample No. 2) and tetramethyltellurourea (Sample No. 3) are disclosed in Canadian Patent No. 800,958 at page 2.

The amount set forth in Table 1 is based on 1 mole of silver halide.

As is evident from the results of the sensitivity set forth in Table 1, the samples No. 4 to No. 10 of the present invention have a high sensitivity. The sensitivity is analogous to that of the samples No. 2 and 3 containing a conventional tellurium sensitizer, and is much higher than that of the sample No. 1 containing a sulfur sensitizer (sodium thiosulfate). As is also evident from the results of "γ", the samples of the invention have a high contrast (a hard gradation), while the samples containing a conventional sensitizer has a low contrast (a soft gradation). Further, the occurrence of the fog is reduced by using the samples of the invention. Furthermore, a favorable result was obtained, even though the tellurium sensitizer of the present invention was used in combination with a sulfur sensitizer or a selenium sensitizer.

EXAMPLE 2

In water was dissolved potassium bromide, the following thioether and gelatin, and the solution was kept at 70° C. To the solution were added silver nitrate solution and silver salt solution containing potassium iodide and potassium bromide while stirring according to a double jet method.

Thioether: $HO(CH_2)_2S(CH_2)_2S(CH_2)_2OH$

The emulsion was then cooled to 35° C., desalted according to a conventional flocculation method, and heated to 40° C. To the emulsion were further added gelatin, and the emulsion was adjusted to pH 6.8.

The obtained tabular silver halide emulsion had the mean grain size of 1.25 μm and the thickness of 0.17 μm.

The aspect ratio was 7.4. The silver iodide content was 3 mole %. The pAg value at 40° C. was 8.4.

The obtained emulsion was divided into 7 parts, and heated to 62° C. To each of the parts was added the sensitizer set forth in Table 2, and the emulsion was chemically sensitized under the optimum conditions.

In water was dissolved 100 g of each of the emulsions (containing 0.08 mole of silver). To the solution were added sodium salt of anhydro-5-chloro-5'-phenyl-9-ethyl-3,3'-di(3-sulfopropyl)oxacarbocyaninehydroxyde (500 mg/1 mole of silver halide) as a sensitizing dye and potassium chloride (200 mg/1 mole of silver halide). To the mixture were further added the following solutions (1) to (4) in the order while stirring to prepare a coating solution for the silver halide emulsion layer.

(1) 2 ml of 3% solution of 4-hydroxy-6-methyl-1,3,3a,7-tetrazaindene (2) 2.2 ml of 2% solution of the compound (a)

(a)

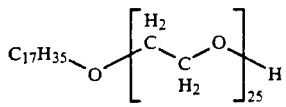

(3) 1.6 ml of 2% solution of the compound (b)

(b)

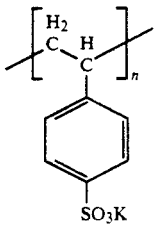

(n = about 3,000)

(4) 3 ml of 2% solution of sodium salt of 2,4-dichloro-6-hydroxy-S-triazine

Independently, the following (5) to (9) were mixed in the order at 40° C. while stirring to prepare a coating solution for a surface protective layer.

(5) 56.8 g of 14% gelatin solution (6) 3.9 g of polymethyl methacrylate particles (mean particles size: 3.0 μm)

(7) Emulsion of 4.24 g of 10% gelatin solution, 10.6 mg of the compound (c), 0.02 ml of 70% solution of phenol and 0.424 g of the compound (d)

(c)

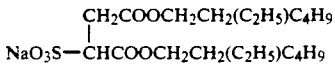

(d)

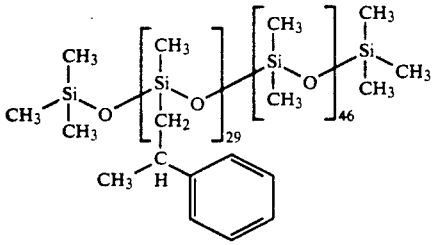

(8) 68.8 ml of water (9) 3 ml of 4.3% solution of the compound (e)

(e)

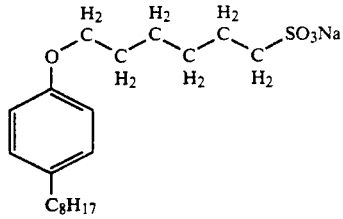

On a polyethylene terephthalate film support were coated the coating solution for the emulsion layer and the coating solution for the surface protective layer simultaneously according to a pressing out method.

Each of the prepared samples No. 11 to No. 17 was exposed to light through a yellow filter and an optical wedge for 1/100 second using a sensitometer, and subjected to a conventional development process at 35° C. for 30 seconds using a developing solution (RD-III for automatic development produced by Fuji Photo Film Co., Ltd.). Each of the samples was then fixed, washed and dried according to a conventional method.

The sensitivity of the samples was evaluated. The sensitivity was measured as the reciprocal of the exposure required for the increase of the optical density to the fogging value+0.2. The sensitivity set forth in Table 1 is the relative value where the value of the sample No. 11 immediately after preparation is 100.

Further, each of the samples was placed at 50° C. and the relative humidity of 80% for 5 days. Each of the stored samples was then evaluated in the same manner as is mentioned above. The results are set forth in Table 2.

TABLE 2

| Sample | Sensitizer | | Sensitivity | |
|---|---|---|---|---|
| No. | Kind | Amount | (0) | (5) |
| 11 | Sodium thiosulfate | $2.1 \times 10^{-5}$ | 100 | 71 |
| 12 | Colloidal tellurium metal | $5.3 \times 10^{-5}$ | 155 | 118 |
| 13 | Tetramethyltellurourea | $1.8 \times 10^{-6}$ | 150 | 114 |
| 14 | (I-1) | $1.8 \times 10^{-6}$ | 150 | 135 |
| 15 | (II-1) | $1.8 \times 10^{-6}$ | 146 | 132 |
| 16 | (II-7) | $1.8 \times 10^{-6}$ | 135 | 126 |
| 17 | (II-6) | $1.8 \times 10^{-6}$ | 141 | 131 |

Remark: Colloidal tellurium metal (Sample No. 12) and tetramethyltellurourea (Sample No. 13) are disclosed in Canadian Patent No. 800,958 at page 2.

The amount set forth in Table 2 is based on 1 mole of silver halide.

The sensitivity (0) means the relative sensitivity immediately after preparation.

The sensitivity (5) means the relative sensitivity after the sample was placed at 50° C. and the relative humidity of 80% for 5 days.

As is evident from the results set forth in Table 2, the samples No. 14 to No. 17 of the present invention have a high sensitivity immediately after preparation. The sensitivity is analogous to that of the samples No. 12 and 13 containing a conventional tellurium sensitizer, and is higher than that of the sample No. 11 containing a sulfur sensitizer. As is also evident from the results, the samples of the invention have a high sensitivity, even if the samples were placed under severe conditions.

We claim:

1. A silver halide photographic material which comprises a silver halide emulsion layer provided on a support, wherein the silver halide emulsion is sensitized with a tellurium sensitizer represented by the formula (I):

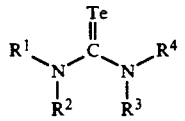

(I)

in which each of $R^1$, $R^2$, $R^3$ and $R^4$ independently is an alkyl group, a cycloalkyl group, an alkenyl group, an alkynyl group, an aralkyl group, an aryl group, a heterocyclic group or an acyl group, each of which may have a substituent group; at least two of $R^1$, $R^2$, $R^3$ and $R^4$ are combined with each other to form a heterocyclic ring.

2. The photographic material as claimed in claim 1, wherein each of $R^1$, $R^2$, $R^3$ and $R^4$ in the formula (I) independently is an alkyl group, a cycloalkyl group, an alkenyl group, an aralkyl group, an aryl group or a heterocyclic group, each of which may have a substituent group.

3. The photographic material as claimed in claim 1, wherein each of $R^1$, $R^2$, $R^3$ and $R^4$ in the formula (I) independently is an alkyl group or an aryl group, each of which may have a substituent group.

4. The photographic material as claimed in claim 1, wherein the tellurium sensitizer is represented by the formula (Ia):

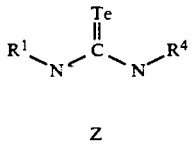

(Ia)

in which each of $R^1$ and $R^4$ independently is an alkyl group, a cycloalkyl group, an alkenyl group, an alkynyl group, an aralkyl group, an aryl group, a heterocyclic group or an acyl group, each of which may have a substituent group; and Z is an atomic group which forms a heterocyclic ring.

5. The photographic material as claimed in claim 4, wherein Z in the formula (Ia) is an alkylene group, an alkenylene group or an arylene group, each of which may have a substituent group.

6. The photographic material as claimed in claim 4, wherein the heterocyclic ring formed by Z in the formula (Ia) is a 5-membered or 6-membered ring.

7. The photographic material as claimed in claim 6, wherein the heterocyclic ring formed by Z in the formula (Ia) is a tellurobarbituric acid ring or a tellurouracil ring.

8. The photographic material as claimed in claim 1, wherein the tellurium sensitizer is contained in an amount of $10^{-8}$ to $10^{-4}$ mole based on 1 mole of the silver halide.

9. The photographic material as claimed in claim 1, wherein the silver halide emulsion is sensitized with the tellurium sensitizer at a pAg in the range of 6 to 11.

10. The photographic material as claimed in claim 1, wherein the silver halide emulsion is sensitized with the tellurium sensitizer at a temperature in the range of 40° C. to 95° C.

11. The photographic material as claimed in claim 1, wherein the silver halide emulsion is sensitized with a noble metal sensitizer in addition to the tellurium sensitizer.

12. A silver halide photographic material which comprises a silver halide emulsion layer provided on a support, wherein the silver halide emulsion is sensitized with a tellurium sensitizer represented by the formula (II):

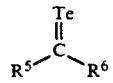

(II)

in which $R^5$ is an alkyl group, a cycloalkyl group, an alkenyl group, an alkynyl group, an aralkyl group, an aryl group or a heterocyclic group, each of which may have a substituent group; $R^6$ is $—NR^7R^8$, $—NR^9—NR^{10}R^{11}$ or $—OR^{12}$; $R^5$ and $R^6$ may be combined with each other to form a heterocyclic ring; each of $R^7$, $R^8$, $R^9$, $R^{10}$, $R^{11}$ and $R^{12}$ independently is an alkyl group, a cycloalkyl group, an alkenyl group, an alkynyl group, an aralkyl group, an aryl group or a heterocyclic group, each of which may have a substituent group; $R^7$ and $R^8$ may be combined with each other to form a heterocyclic ring; and $R^9$ and $R^{11}$ or $R^{10}$ and $R^{11}$ may be combined with each other to form a heterocyclic ring.

13. The photographic material as claimed in claim 12, wherein each of $R^5$, $R^7$, $R^8$, $R^9$, $R^{10}$, $R^{11}$ and $R^{12}$ in the formula (II) independently is an alkyl group, a cycloalkyl group, an aralkyl group, an aryl group or a heterocyclic group, each of which may have a substituent group.

14. The photographic material as claimed in claim 12, wherein each of $R^5$, $R^7$, $R^8$, $R^9$, $R^{10}$, $R^{11}$ and $R^{12}$ in the formula (II) independently is an alkyl group or an aryl group, each of which may have a substituent group.

15. The photographic material as claimed in claim 12, wherein the tellurium sensitizer is contained in an amount of $10^{-8}$ to $10^{-4}$ mole based on 1 mole of the silver halide.

16. The photographic material as claimed in claim 12, wherein the silver halide emulsion is sensitized with the tellurium sensitizer at a pAg in the range of 6 to 11.

17. The photographic material as claimed in claim 12, wherein the silver halide emulsion is sensitized with the tellurium sensitizer at a temperature in the range of 40° C. to 95° C.

18. The photographic material as claimed in claim 12, wherein the silver halide emulsion is sensitized with a noble metal sensitizer in addition to the tellurium sensitizer.

* * * * *